US010894308B2

(12) United States Patent
Hu

(10) Patent No.: US 10,894,308 B2
(45) Date of Patent: Jan. 19, 2021

(54) STAPLER

(71) Applicant: APEX MFG. CO., LTD., Taichung (TW)

(72) Inventor: Chih-Wei Hu, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 117 days.

(21) Appl. No.: 16/221,131

(22) Filed: Dec. 14, 2018

(65) Prior Publication Data

US 2020/0189082 A1 Jun. 18, 2020

(51) Int. Cl.
*B25C 5/02* (2006.01)

(52) U.S. Cl.
CPC ..... *B25C 5/0285* (2013.01); *B25C 5/0257* (2013.01)

(58) Field of Classification Search
CPC ..... B25C 5/2057
USPC ..... 227/120, 8, 130, 131, 151, 156
See application file for complete search history.

(56) References Cited

U.S. PATENT DOCUMENTS 2,746,043 A * 5/1956 Zaller ..... B25C 5/06 227/127
2,775,763 A * 1/1957 Flammer ..... H02G 3/26 227/77
2,923,938 A * 2/1960 Rinehardt ..... B25C 5/10 227/146
4,805,824 A * 2/1989 Erickson ..... B25B 31/00 206/340
5,884,829 A * 3/1999 Wingert ..... B25C 1/008 227/109
6,848,607 B2 * 2/2005 Boswinkel ..... B25C 5/0257 227/132
7,011,242 B2 * 3/2006 Barlow ..... B25C 5/00 132/902
2011/0180583 A1 * 7/2011 Wang ..... B25C 5/1644 227/109
2013/0221056 A1 * 8/2013 Chen ..... B25C 5/1658 227/120

* cited by examiner

*Primary Examiner* — Nathaniel C Chukwurah
(74) *Attorney, Agent, or Firm* — Muncy, Geissler, Olds & Lowe, PC

(57) ABSTRACT

The stapler includes a main body, a trigger, a striking mechanism, and a stopping plate. The main body has an outlet at a first end portion. The trigger is pivotally connected to the main body with an end, and the other end extends toward the first end portion for being pressed toward the main body. The striking mechanism includes a striker at the first end portion and a releasing unit for releasing the striker. The trigger switches the releasing unit between a release mode and an accumulating mode so that the striker can move toward the outlet. The striker has a concave face facing the outlet for striking a staple unit. The stopping plate is disposed on the first end portion and is for the staple unit to abut against horizontally. The stopping plate has at least one recess at an end thereof facing the outlet.

8 Claims, 7 Drawing Sheets

STAPLER

BACKGROUND OF THE INVENTION

Field of the Invention

The present invention relates to a stapler.

Description of the Prior Art

Stapler or nailing gun is widely used in carpentry or upholstery. The stapler is used to strike staples out in order to fix wires or pipes. However, when using conventional stapler, the staple cannot fix the wires or pipes firmly, or the staples rebound to break the wires or pipes down. As a result, electric leakage, bad transmission of signals, or fluid leakage may happen, and the wires or pipes cannot be fixed firmly.

SUMMARY OF THE INVENTION

The main object of the present invention is to provide a stapler which is able to reduce the rebound of the staple.

To achieve the above and other objects, the stapler of the present invention includes a main body, a trigger, a striking mechanism, and a stopping plate.

The main body has an outlet at a first end portion thereof. The trigger is pivotally connected to the main body with an end thereof, and an other end of the trigger extends toward the first end portion and is adapted for being pressed toward the main body. The striking mechanism includes a striker disposed on the first end portion and a releasing unit which is able to release the striker. The trigger is adapted for switching the releasing unit between a release mode and an accumulating mode so that the striker is able to move toward the outlet. The striker has a concave face facing the outlet. The concave face is adapted for striking a staple unit. The stopping plate is disposed on the first end portion. The stopping plate is adapted for the staple unit to abut against along a direction traversing a movement direction of the striker. The stopping plate has at least one recess at an end thereof facing the outlet.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
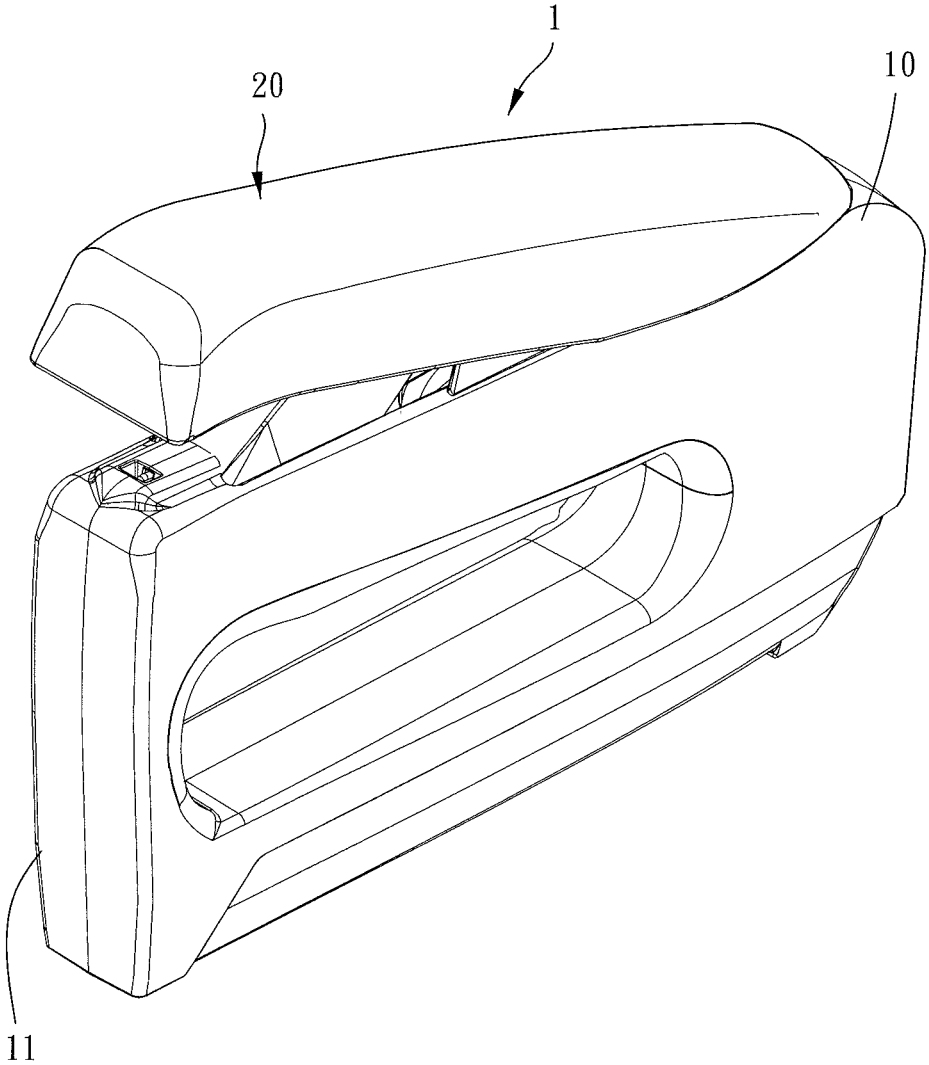
FIG. 1 is a stereogram of the present invention.
Figure 2:
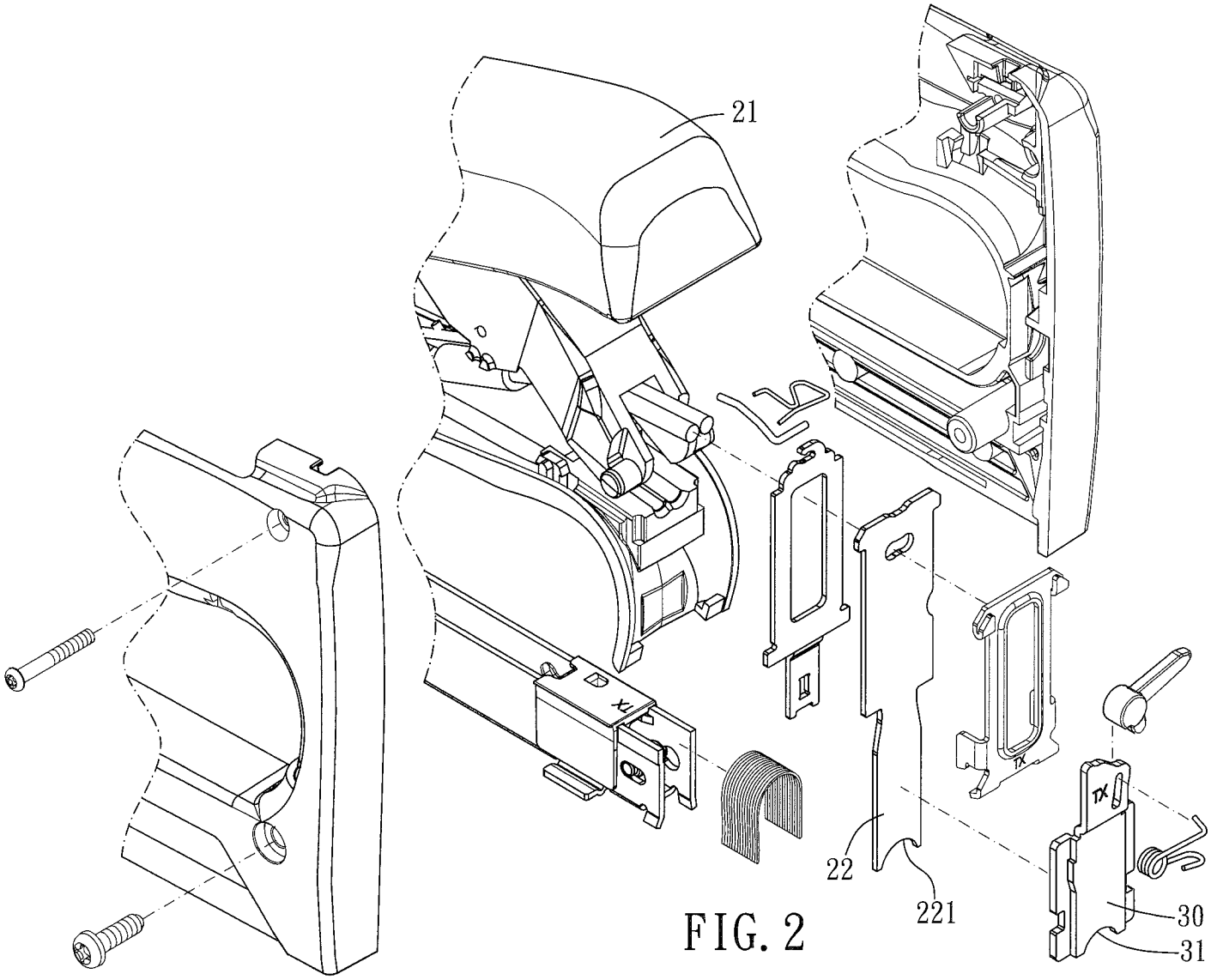
FIG. 2 is a breakdown drawing of the present invention.
Figure 3:
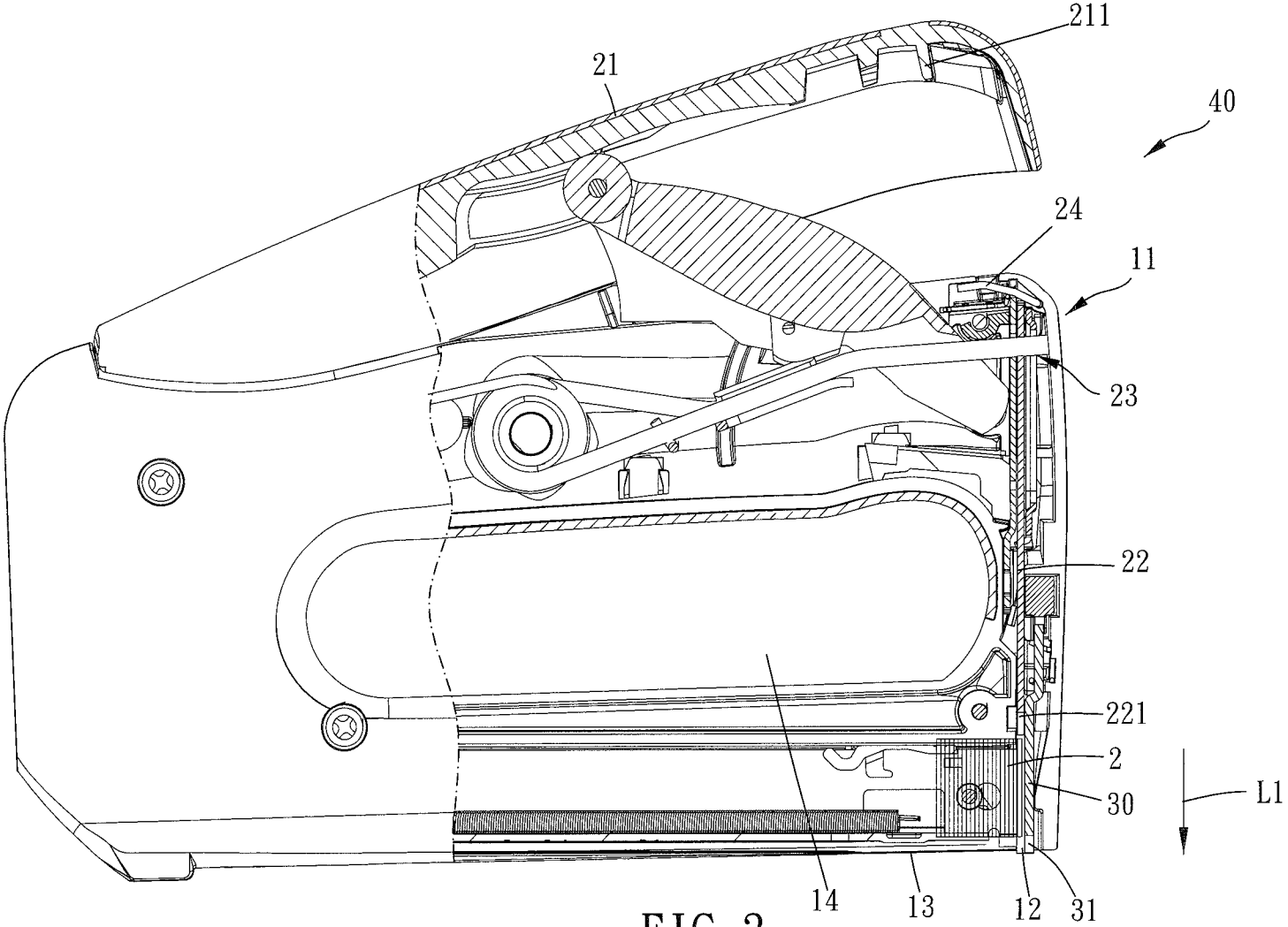
FIG. 3 is a partial profile of the present invention.
Figure 4:
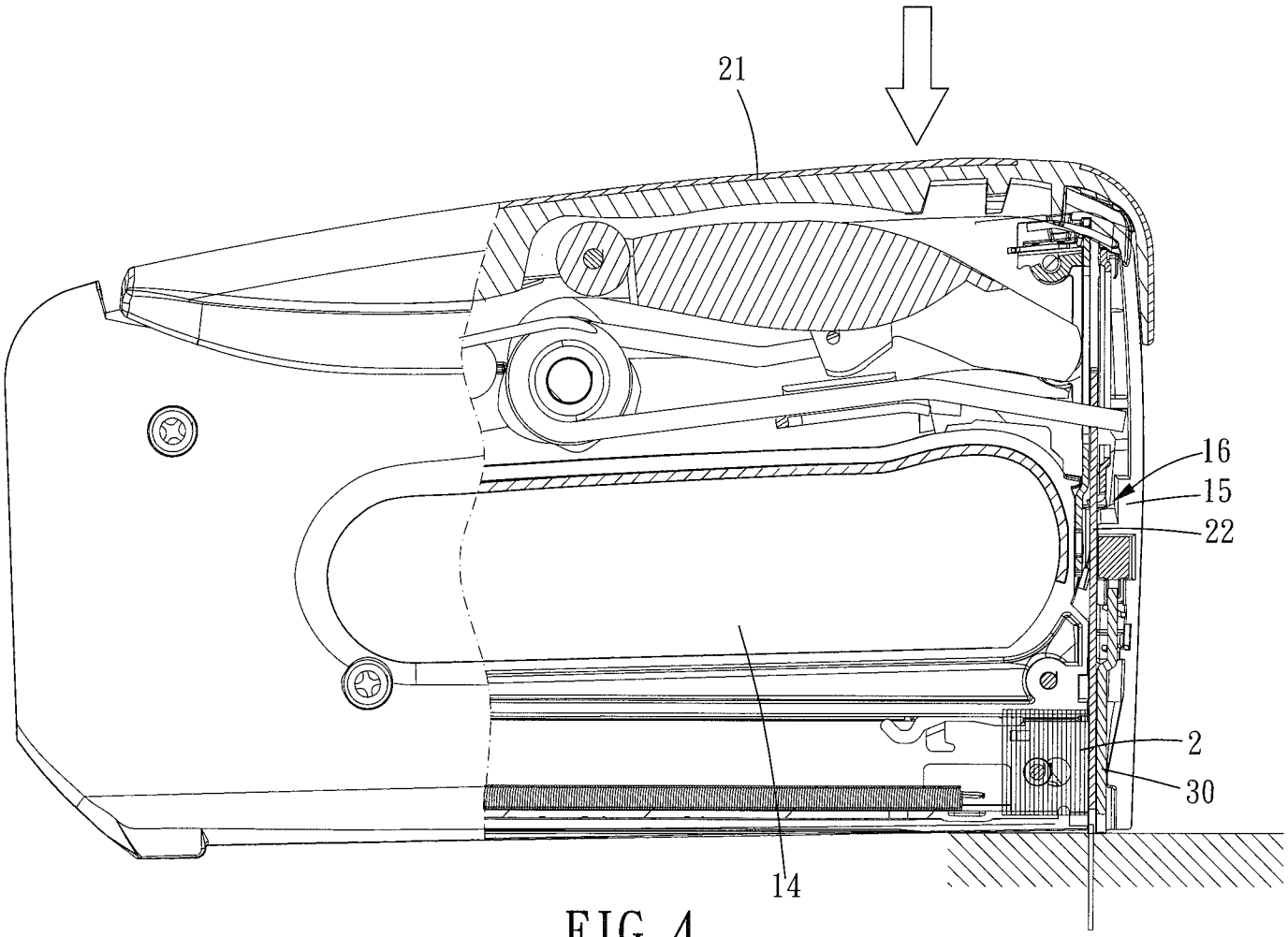
FIG. 4 is an illustration of the present invention.
Figure 5:
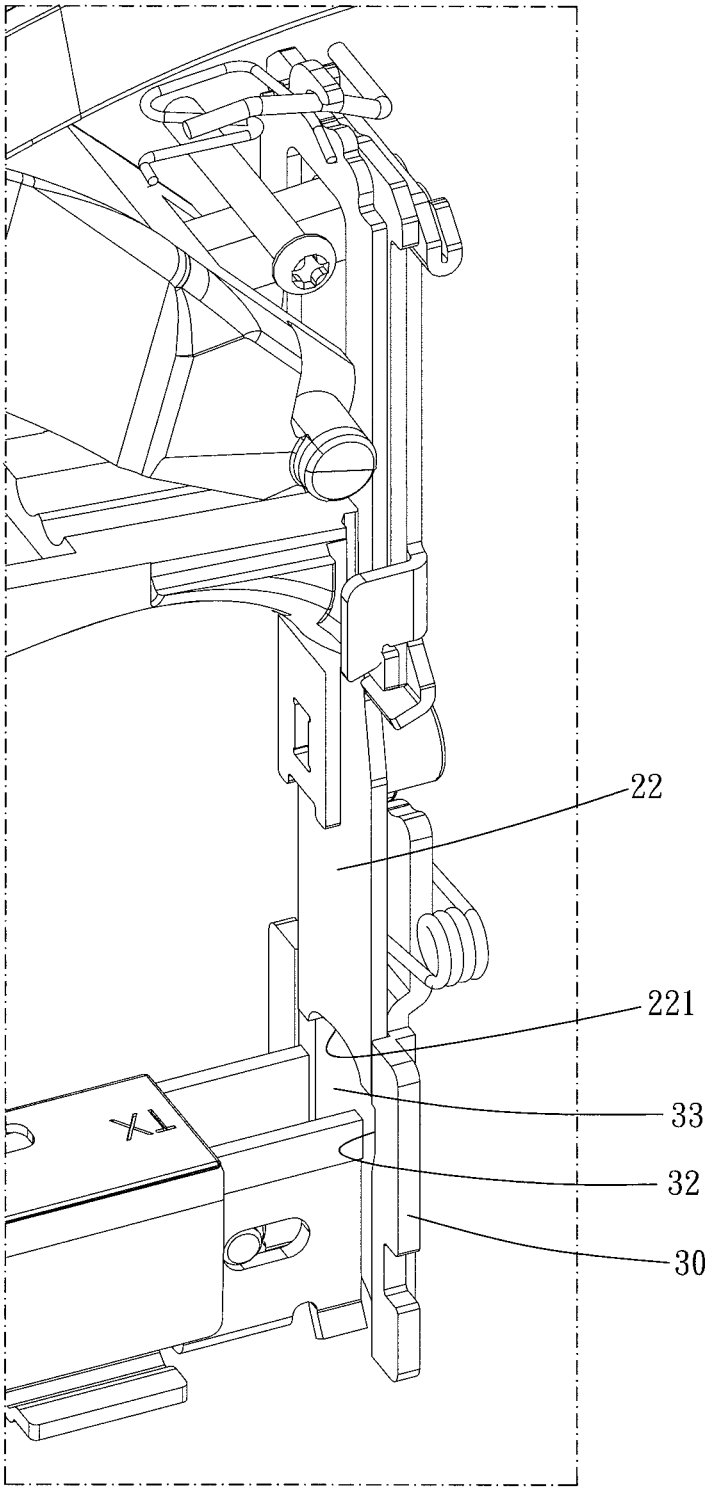
FIG. 5 is a partial stereogram of the present invention.
Figure 6:
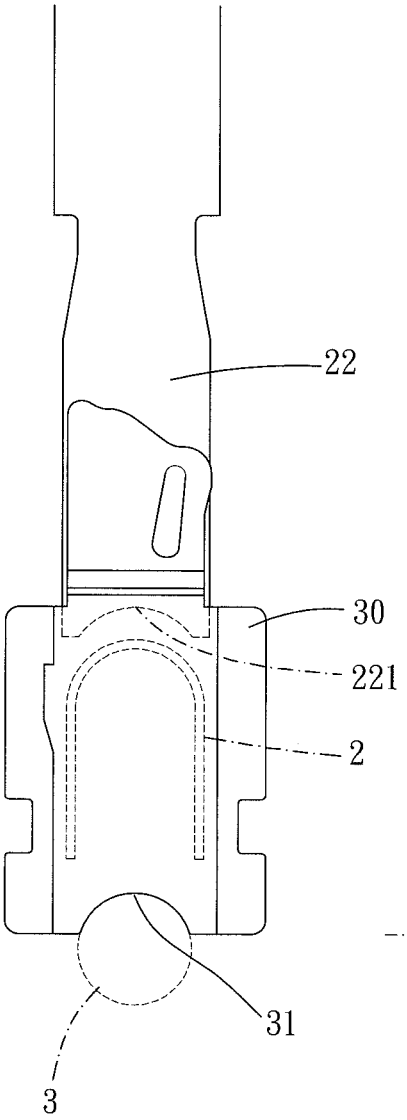
FIG. 6 and FIG. 7 are partial illustrations of the present invention.
Figure 7:
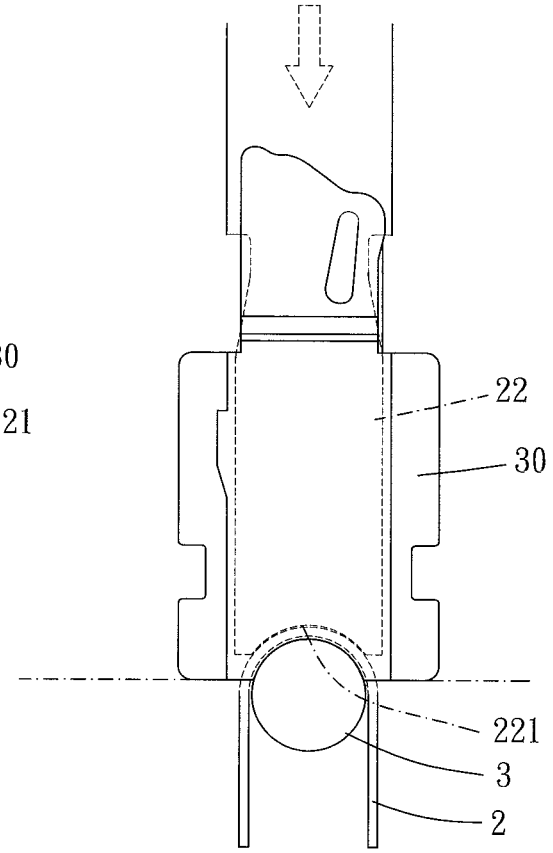

Please refer to FIG. 1 to FIG. 7, the stapler 1 of the present invention includes a main body 10, an operating mechanism 20, and a stopping plate 30.

The main body 10 has an outlet 12 at a first end portion 11 thereof. The operating mechanism 20 includes a trigger

21 and a striking mechanism 40. The trigger 21 is pivotally connected to the main body 10 with an end thereof, and an other end of the trigger 21 extends toward the first end portion 11 and is adapted for being pressed toward the main body 10. The striking mechanism 40 includes a striker 22 disposed on the first end portion 11 and a releasing unit 23 which is able to release the striker 22. The trigger 21 is adapted for switching the releasing unit 23 between a release mode and an accumulating mode so that the striker 22 is able to move toward the outlet 12. Specifically, the trigger 21 has a triggering structure 211. The releasing unit 23 further includes a bar-linkage portion 24 which is elastic to tend to restore. The triggering structure 211 presses the bar-linkage portion 24 to release the striker 22 to allow it to move toward the outlet 12. Besides, the striker 22 has a concave face 221 facing the outlet 12. The concave face 221 is adapted for striking a staple unit 2. The stopping plate 30 is disposed on the first end portion 11. The stopping plate 30 is adapted for the staple unit 2 to abut against along a direction traversing a movement direction of the striker 22. The stopping plate 30 has at least one recess 31 at an end thereof facing the outlet 12. Thereby, the rebound of the staple can be reduced, and the striking becomes precisely. In the present embodiment, a free end of the trigger 21 extends to at least a position corresponding to the striker 22 to make it easier to press the trigger 21 and to reduce the rebounding of staple. Specifically, the staple unit 2 can be a T-shaped staple, a reversed U-shaped staple, a reversed V-shaped staple, or a reversed U-shaped staple with wave sections or arc sections. The concave face 221 and the recess 31 can be arc-recessed, reversed V-shaped, reversed U-shaped, or others to correspond to the shape of the staple unit 2. In the present embodiment, the staple unit 2 is a reversed U-shaped staple, and the concave face 221 and the recess 31 are an arc concave face and an arc recess respectively to correspond to the staple unit 2.

One of the striker 22 and the stopping plate 30 has a guiding groove extending toward the movement direction of the striker 22, and the other one of the striker 22 and the stopping plate 30 is slidably arranged on the guiding groove. In the present embodiment, the stopping plate 30 has the guiding groove 32. The guiding groove 32 is formed with a stopping face 33 toward the striker 22. The stopping face 33 is adapted for abutting against the staple unit 2. Thereby, the striker 22 moves smoothly along the guiding groove 32 to prevent staple jamming due to deviation. Besides, the stopping face 33 is a flat surface continuously extending toward the movement direction of the striker 22. Thereby, the staple unit 2 can abut against the stopping face 33 erectly to prevent the staple unit 2 from being stricken obliquely.

In the present embodiment, the concave face 221 of the striker 22 has a smaller curvature than a curvature of the recess 31 of the stopping plate 30.

Besides, the main body 10 has a bottom face 13. The bottom face 13 is adapted for abutting against a base face. At least part of the recess 31 of the stopping plate 30 is protruded from the bottom face 13. Preferably, the stopping plate 30 is movable along a thickness direction L1 traversing the bottom face 13. Thereby, the position of the stopping plate 30 can be adjusted according to needs, such as sizes of wires 3, to position objects such as the wires 3.

In the present embodiment, the main body 10 has a holding hole 14 extending along the thickness direction. The holding hole 14 can be a through hole or a blind hole. Preferably, the main body 10 has a terminal wall 15 at the first end portion 11. A receiving space 16 is defined between the terminal wall 15 and the holding hole 14. The striker 22 is able to pass through the receiving space 16. A size of the receiving space 16 from the terminal wall 15 to the holding hole 14 is smaller than one fourth a length of the main body 10. Thereby, the space between the holding hole 14 and the terminal wall 15 is only for the striker 22 to pass through so that the user can strike the staple out more precisely. In the present embodiment, the holding hole 14 penetrates the main body 10. The size of the receiving space 16 from the terminal wall 15 to the holding hole 14 is smaller than one thirty-sixth the length of the main body 10.

Figure 8:
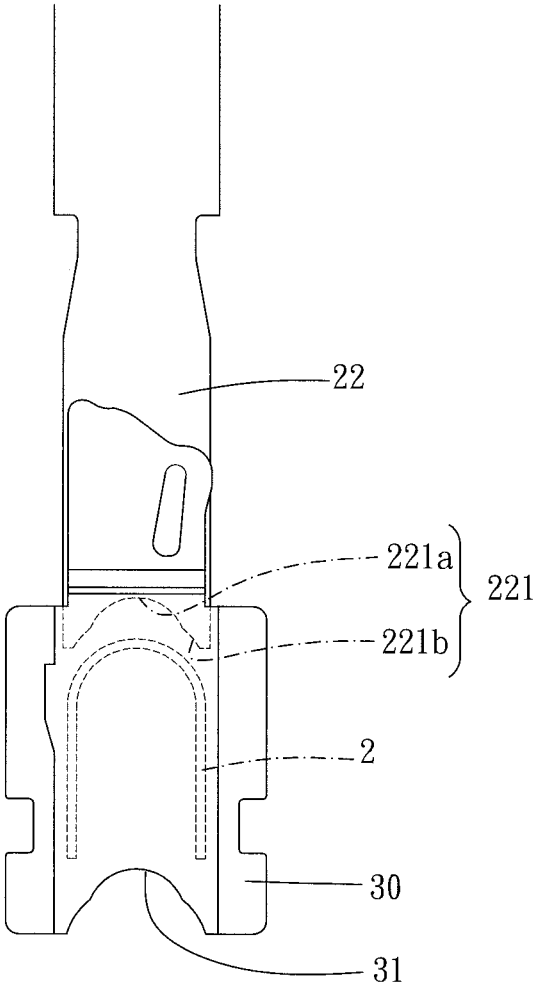
FIG. 8 is a partial front view showing a second embodiment of the present invention.

Please refer to FIG. 8 for another embodiment of the present invention. The concave face 221 of the striker 22 includes at least two arc grooves having different curvatures for staple units in different sizes. Besides, the stopping plate 30 can include at least two recesses 31 to receive wires in different sizes.

In conclusion, the trigger 21 of the present invention is pressed toward the outlet 12, and the striker 22 and the stopping plates 30 have concave face 221 and recess 31 so that the staple unit is prevented from rebounding. Thus, the wire is prevented from being damaged by the staple unit 2. Besides, the staple unit can be stricken out precisely.

What is claimed is:

1. A stapler, including:

a main body, having an outlet at a first end portion thereof;

a trigger, the trigger being pivotally connected to the main body with an end thereof, an other end of the trigger extending toward the first end portion and being adapted for being pressed toward the main body;

a striking mechanism, including a striker disposed on the first end portion and a releasing unit which is able to release the striker, the trigger being adapted for switching the releasing unit between a release mode and an accumulating mode so that the striker is able to move toward the outlet, the striker having a concave face facing the outlet, the concave face being adapted for striking a staple unit; and a stopping plate, disposed on the first end portion, the stopping plate being adapted for the staple unit to abut against along a direction traversing a movement direction of the striker, the stopping plate having at least one recess at an end thereof facing the outlet; wherein the concave face of the striker comprises at least two arc grooves having different curvatures.

2. The stapler of claim 1, wherein one of the striker and the stopping plate has a guiding groove extending toward the movement direction of the striker, the other one of the striker and the stopping plate is slidably arranged on the guiding groove.

3. The stapler of claim 2, wherein the stopping plate has the guiding groove, the guiding groove is formed with a stopping face toward the striker, the stopping face is adapted for abutting against the staple unit.

4. The stapler of claim 1, wherein the main body has a holding hole extending along the thickness direction.

5. The stapler of claim 4, wherein the main body has a terminal wall at the first end portion, a receiving space is defined between the terminal wall and the holding hole, the striker is able to pass through the receiving space, a size of the receiving space from the terminal wall to the holding hole is smaller than one fourth a length of the main body.

6. The stapler of claim 1, wherein a free end of the trigger extends to a position corresponding to the striker; the main body has a bottom face, the bottom face is adapted for abutting against a base face, at least part of the recess of the stopping plate is protruded from the bottom face; the stopping plate is movable along a thickness direction traversing to the bottom face; the concave face of the striker has a smaller curvature than a curvature of the recess of the stopping plate; the main body has a holding hole extending along the thickness direction; the holding hole penetrates the main body; the main body has a terminal wall at the first end portion, a receiving space is defined between the terminal wall and the holding hole, the striker is able to pass through the receiving space, the size of the receiving space from the terminal wall to the holding hole is smaller than one thirty-sixth the length of the main body; the stopping face is a flat surface continuously extending toward the movement direction of the striker; the concave face and the recess are an arc concave face and an arc recess respectively which correspond to the staple unit.

7. A stapler, including:

a main body, having an outlet at a first end portion thereof;

a trigger, the trigger being pivotally connected to the main body with an end thereof, an other end of the trigger extending toward the first end portion and being adapted for being pressed toward the main body;

a striking mechanism, including a striker disposed on the first end portion and a releasing unit which is able to release the striker, the trigger being adapted for switching the releasing unit between a release mode and an accumulating mode so that the striker is able to move toward the outlet, the striker having a concave face facing the outlet, the concave face being adapted for striking a staple unit; and a stopping plate, disposed on the first end portion, the stopping plate being adapted for the staple unit to abut against along a direction traversing a movement direction of the striker, the stopping plate having at least one recess at an end thereof facing the outlet; wherein the main body has a bottom face, the bottom face is adapted for abutting against a base face, and at least part of the recess of the stopping plate is protruded from the bottom face, wherein the stopping plate is movable along a thickness direction traversing the bottom face.

8. A stapler, including:

a main body, having an outlet at a first end portion thereof;

a trigger, the trigger being pivotally connected to the main body with an end thereof, an other end of the trigger extending toward the first end portion and being adapted for being pressed toward the main body;

a striking mechanism, including a striker disposed on the first end portion and a releasing unit which is able to release the striker, the trigger being adapted for switching the releasing unit between a release mode and an accumulating mode so that the striker is able to move toward the outlet, the striker having a concave face facing the outlet, the concave face being adapted for striking a staple unit; and a stopping plate, disposed on the first end portion, the stopping plate being adapted for the staple unit to abut against along a direction traversing a movement direction of the striker, the stopping plate having at least one recess at an end thereof facing the outlet; wherein the concave face of the striker has a smaller curvature than a curvature of the recess of the stopping plate.

* * * * *